US005961423A

United States Patent [19]

Sellers

[11] Patent Number: 5,961,423

[45] Date of Patent: Oct. 5, 1999

[54] MULTIPLE USE EXERCISE MACHINE

[76] Inventor: Tyrone D. Sellers, 3518 W. Richwood Blvd., Peoria, Ill. 61104

[21] Appl. No.: 08/810,833

[22] Filed: Mar. 4, 1997

[51] Int. Cl.[6] ..... A63B 22/00; A63B 22/06; A63B 21/00

[52] U.S. Cl. ..... 482/57; 482/52; 482/70; 482/72

[58] Field of Search ..... 482/51, 52, 57, 482/60, 62, 58, 70, 71, 72, 63

[56] References Cited

U.S. PATENT DOCUMENTS

| | | | |
|---|---|---|---|
| Re. 34,959 | 5/1995 | Potts . | |
| 3,017,180 | 1/1962 | Aronsohn | 482/62 |
| 4,023,795 | 5/1977 | Pauls . | |
| 4,140,312 | 2/1979 | Buchmann . | |
| 4,705,269 | 11/1987 | De Boer et al. | 482/62 |
| 4,708,338 | 11/1987 | Potts . | |
| 4,709,918 | 12/1987 | Grinblat . | |
| 4,720,093 | 1/1988 | Del Mar | 482/70 |
| 4,728,099 | 3/1988 | Pitre | 482/52 |
| 4,733,858 | 3/1988 | Lan . | |
| 4,842,268 | 6/1989 | Jenkins | 482/62 |
| 4,949,993 | 8/1990 | Stark et al. | 482/52 |
| 5,226,866 | 7/1993 | Engel et al. | 482/70 |
| 5,254,067 | 10/1993 | Habing et al. | 482/57 |
| 5,290,211 | 3/1994 | Stearns . | |
| 5,299,992 | 4/1994 | Wilkinson | 482/62 |
| 5,496,241 | 3/1996 | Sellers . | |
| 5,503,610 | 4/1996 | Metcalf et al. | 482/70 |

*Primary Examiner*—Stephen R. Crow
*Attorney, Agent, or Firm*—Howell & Haferkamp, L.C.

[57] ABSTRACT

An exercise machine is operable in a first mode for simulating a cycling activity and operable in a second mode for simulating a stair climbing activity. The machine comprises a frame and a flywheel operatively connected to the frame for rotation relative to the frame about a flywheel axis. At least one stepping member is operatively connected to the frame for movement relative to the frame between raised and lowered positions. The stepping member has a stepping surface positioned and configured to be stepped upon by a user. A stair-climbing drive mechanism is operatively connected to the stepping member and operatively connected to the flywheel in a manner to cause the flywheel to rotate about the flywheel axis upon movement of the stepping member from its raised position to its lowered position. At least one crank is operatively connected to the frame for motion in a circle about a crank axis. A cycling drive mechanism is operatively connected to the crank and operatively connected to the flywheel in a manner to cause the flywheel to rotate about the flywheel axis upon circular movement of the crank about the crank axis.

13 Claims, 5 Drawing Sheets

MULTIPLE USE EXERCISE MACHINE

BACKGROUND OF THE INVENTION

The present invention relates generally to exercise machines, and more particularly to an exercise machine for performing several different exercises.

There are many kinds of exercise machines for facilitating an aerobic workout. The most common types of machines simulate aerobic activities such cycling, rowing, skiing, or stair climbing.

A disadvantage of such exercise machines is that they are generally capable of simulating only one aerobic activity. In other words, a cycling machine is capable of simulating only a cycling activity, a stair climbing machine is capable of simulating only a stair climbing activity, and a skiing machine is capable of simulating only a skiing activity. Because of this, several machines must be employed to accommodate a workout with multiple aerobic activities. The need for several different machines creates a need for a large floor space to accommodate the machines. Also, purchasing several different machines can be relatively expensive. There is a need, therefore, for an improved exercise machine which does not suffer the disadvantages of prior machines.

SUMMARY OF THE INVENTION

Among the several objects of this invention may be noted the provision of an improved exercise machine capable of being used to simulate several different aerobic activities; the provision of such a machine for providing true simulations of several aerobic activities including cycling, rowing, cross-country skiing and stair climbing; and the provision of such a machine which is relatively compact.

Briefly, an exercise machine of the present invention is operable in a first mode for simulating a cycling activity and operable in a second mode for simulating a stair climbing activity. The machine comprises a frame and a flywheel operatively connected to the frame for rotation relative to the frame about a flywheel axis. At least one stepping member is operatively connected to the frame for movement relative to the frame between raised and lowered positions. The stepping member has a stepping surface positioned and configured to be stepped upon by a user. A stair-climbing drive mechanism is operatively connected to the stepping member and operatively connected to the flywheel in a manner to cause the flywheel to rotate about the flywheel axis upon movement of the stepping member from its raised position to its lowered position. At least one crank is operatively connected to the frame for motion in a circle about a crank axis. A cycling drive mechanism is operatively connected to the crank and operatively connected to the flywheel in a manner to cause the flywheel to rotate about the flywheel axis upon circular movement of the crank about the crank axis.

In another aspect of the present invention, an exercise machine is operable in a first mode for simulating an activity such as skiing or rowing involving reciprocating linear motion, and operable in a second mode for simulating a stair climbing activity. The machine comprises a frame, and a flywheel operatively connected to the frame for rotation relative to the frame about a flywheel axis. At least one stepping member is operatively connected to the frame for movement relative to the frame between raised and lowered positions. The stepping member has a stepping surface positioned and configured to be stepped upon by a user. A stair-climbing drive mechanism is operatively connected to the stepping member and operatively connected to the flywheel in a manner to cause the flywheel to rotate about the flywheel axis upon movement of the stepping member from its raised position to its lowered position. A linearly moveable member is mounted on the frame for linear reciprocating movement along a longitudinal axis between forward and rearward positions. A skier/rower drive mechanism is operatively connected to the linearly moveable member and operatively connected to the flywheel in a manner to cause the flywheel to rotate about the flywheel axis upon movement of the linearly moveable member between its forward and rearward positions in at least one direction.

In yet another aspect of the present invention an exercise machine is operable in a first mode for simulating an activity such as skiing or rowing involving reciprocating linear motion, and operable in a second mode for simulating a cycling activity. The machine comprises a frame and a flywheel operatively connected to the frame for rotation relative to the frame about a flywheel axis. A linearly moveable member is mounted on the frame for linear reciprocating movement along a longitudinal axis between forward and rearward positions. A skier/rower drive mechanism is operatively connected to the linearly moveable member and operatively connected to the flywheel in a manner to cause the flywheel to rotate about the flywheel axis upon movement of the linearly moveable member between its forward and rearward positions in at least one direction. At least one crank is operatively connected to the frame for motion in a circle about a crank axis. A cycling drive mechanism is operatively connected to the crank and operatively connected to the flywheel in a manner to cause the flywheel to rotate about the flywheel axis upon circular movement of the crank about the crank axis.

In yet another aspect of the present invention an exercise machine is operable in a first mode for simulating a cycling activity and operable in a second mode for simulating a stair climbing activity. The machine comprises a frame, and a first flywheel operatively connected to the frame for rotation relative to the frame about a flywheel axis. At least one stepping member is operatively connected to the frame for movement relative to the frame between raised and lowered positions. The stepping member has a stepping surface positioned and configured to be stepped upon by a user. A first drive mechanism is operatively connected to the stepping member and operatively connected to the first flywheel in a manner to cause the first flywheel to rotate about the flywheel axis upon movement of the stepping member from its raised position to its lowered position. A second flywheel is operatively connected to the frame for rotation relative to the frame about the flywheel axis. The first and second flywheels are rotatable independently of each other. At least one crank is operatively connected to the frame for motion in a circle about a crank axis. A second drive mechanism is operatively connected to the crank and operatively connected to the second flywheel in a manner to cause the second flywheel to rotate about the flywheel axis upon circular movement of the crank about the crank axis.

In yet another aspect of the present invention, an exercise machine is operable for simulating a cycling activity. The machine comprises a frame, and a flywheel operatively connected to the frame for rotation relative to the frame about a flywheel axis. The shaft is operatively connected to the frame for rotation relative to the frame about a crank axis. A pair of offset cranks are operatively connected to the shaft for rotation of the shaft about the crank axis upon rotation of the pair of offset cranks about the crank axis. A cycling drive mechanism is operatively connected to the shaft and operatively connected to the flywheel in a manner to cause the flywheel to rotate about the flywheel axis upon circular movement of the crank about the crank axis. A seat assembly is operatively connected to the frame. The seat assembly comprises a seat portion and a seat support mechanism for supporting the seat portion. The support mechanism is moveable between first and second positions. The support mechanism supports the seat portion in a recumbent position relative to the offset cranks when the support mechanism is in its first position. The support mechanism supports the seat portion in an upright position relative to the offset cranks when the support mechanism is in its second position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
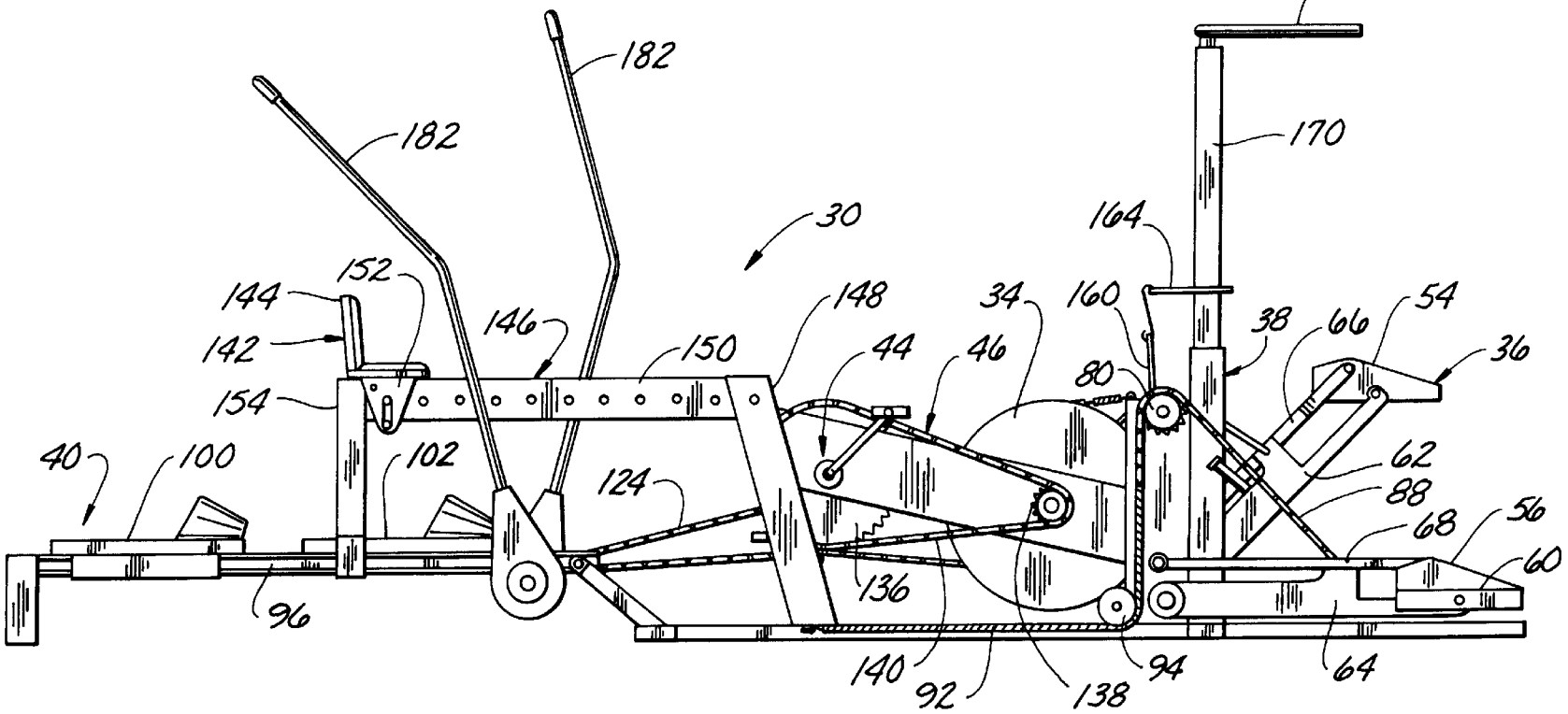
FIG. 1 is a right side elevational view of an exercise machine of the present invention.

Referring now to the drawings, and first more particularly to FIGS. 1–4, an exercise machine of the present invention is indicated in its entirety by the reference numeral 30. The exercise machine 30 is operable in a first mode for simulating a stair climbing activity, a second mode for simulating an activity such as skiing or rowing involving reciprocating linear motion, and a third mode for simulating a cycling activity. The exercise machine 30 comprises a frame, generally indicated at 32, a flywheel 34, a stair-climbing mechanism, generally indicated at 36, a stair-climbing drive mechanism, generally indicated at 38, a linear motion mechanism, generally indicated at 40, a skier drive mechanism, generally indicated at 42, a cycling mechanism, generally indicated at 44, and a cycling drive mechanism, generally indicated at 46.

The flywheel 34 is keyed to a flywheel shaft 50 (FIG. 3) which is journaled in the frame 32 via bearings 52 for rotation of the flywheel and flywheel shaft about a horizontal flywheel axis $X_f$. Preferably, the flywheel is a disc-shaped member. Alternatively, the flywheel could comprise a fan or any other suitable rotor without departing from the scope of this invention.

Figure 2:
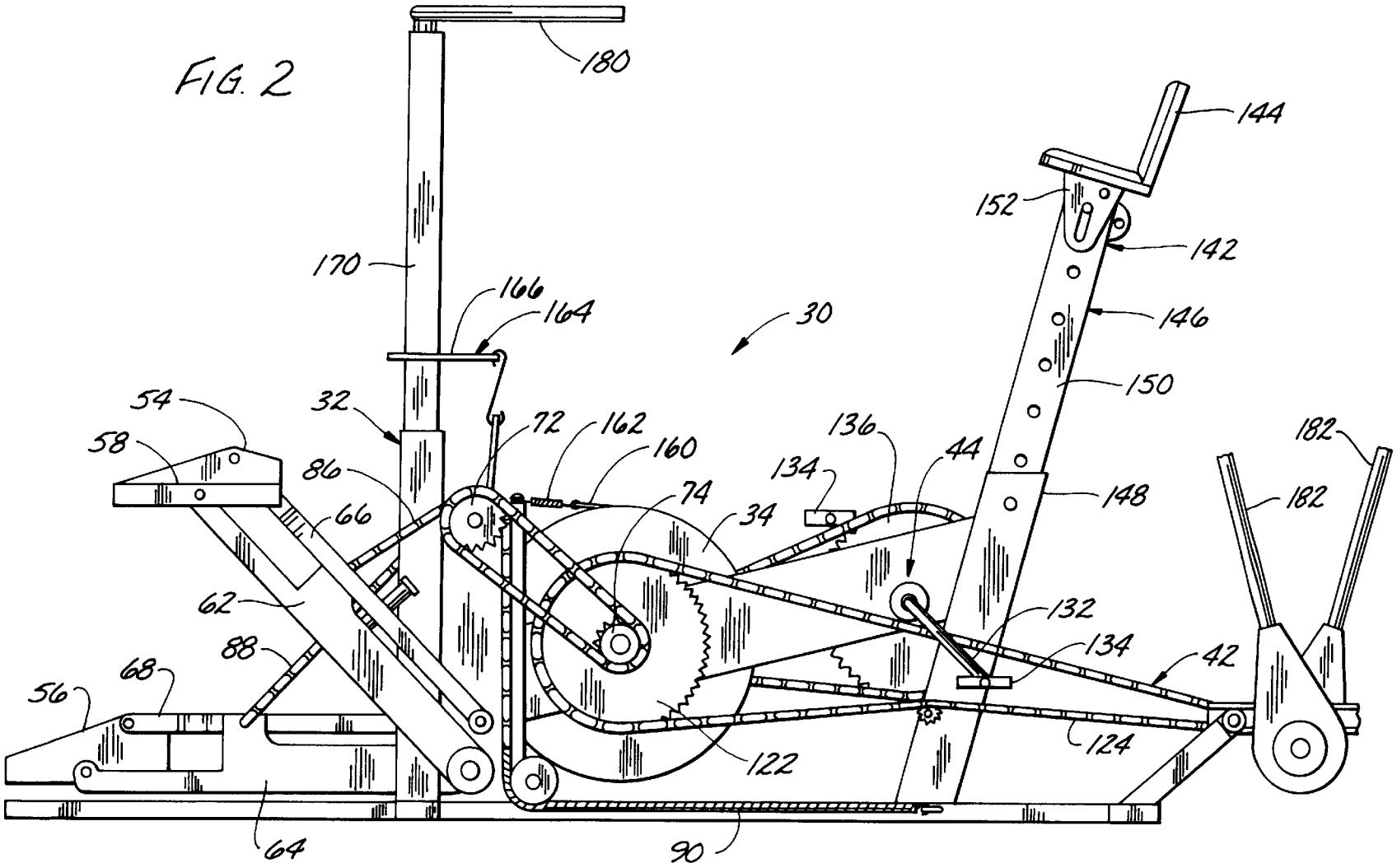
FIG. 2 is an enlarged, fragmented left side elevational view of the exercise machine of FIG. 1.

The stair-climbing mechanism 38 comprises right (first) and left (second) stepping members 54, 56 having right and left generally horizontal stepping surfaces 58, 60 configured to be stepped upon by a user. A right support arm 62 is pivotally connected at one end to the frame 32 and pivotally connected at its opposite end to the right stepping member 54. A left support arm 64 is pivotally connected at one end to the frame 32 and pivotally connected at its opposite end to the left stepping member 56. A right stabilizing arm 66, generally parallel to the right support arm 62, is pivotally connected at one end to the frame 32 and pivotally connected at its opposite end to the right stepping member 54. A left stabilizing arm 68, generally parallel to the left support arm 64, is pivotally connected at one end to the frame 32 and pivotally connected at its opposite end to the left stepping member 56. The support arms 62, 64 and stabilizing arms 66, 68 connect the stepping members 54, 56 to the frame for movement of the stepping members between raised and lowered positions. FIGS. 1 and 2 show the right stepping member 54 in its raised position and the left stepping member 56 in its lowered position. The stepping members are moveable independently of each other between their raised and lowered positions. The support arms and stabilizing arms connect the stepping members to the frame in a manner so that the stepping surfaces 58, 60 remain substantially level (horizontal) as they are moved between their raised and lowered positions.

The right and left support arms 62, 64 of the stair-climbing mechanism 36 are connected to the flywheel via the stair-climbing drive mechanism 38. The stair-climbing drive mechanism 38 comprises a drive shaft 70, a first drive gear 72, and a driven gear 74. The drive shaft 70 is journaled in the frame 32 via suitable bearings for rotation of the drive shaft about a horizontal axis. The first drive gear 72 is keyed to and rotates with the drive shaft 70. The driven gear 74 is coupled to the flywheel shaft 50 via a one-way clutch. The one-way clutch effects driving engagement between the driven gear 74 and flywheel shaft 50 when the driven gear is rotated in a first direction (e.g., counter-clockwise as viewed in FIG. 2) and driving disengagement when the driven gear is rotated in an opposite direction (e.g., clockwise as viewed in FIG. 2). Accordingly, when the driven gear 74 is rotated in the first direction, the flywheel shaft 50 and flywheel rotate with the driven gear, and when the driven gear stops rotating, it permits the flywheel shaft and flywheel to continue rotating in such first direction. An endless-loop chain 76 is trained around the driven gear 74 and the first drive gear 72 so that rotation of the first drive gear causes rotation of the driven gear. Second and third drive gears 78, 80 are coupled to the drive shaft 70 via one-way clutches 82, 84. The clutches 82, 84 effect driving engagement between the second and third drive gears 78, 80 and the drive shaft 70 when the second and third drive gears are rotated in the first direction (e.g., counterclockwise direction as viewed in FIG. 2) and allow free wheeling of the second and third drive gears relative to the drive shaft in the opposite direction. Thus, rotation of the second drive gear 78 in the first direction causes rotation of the drive shaft 70 and first drive gear 72 even when the third drive gear 80 is rotating in the opposite direction, and rotation of the third drive gear in the first direction causes rotation of the drive shaft and first drive gear even when the second drive gear is rotating in the opposite direction. The stair-climbing drive mechanism 36 further includes right and left chains 86, 88 and right and left return springs 90, 92. The right and left chains 86, 88 are respectively attached at first ends to the right and left support arms 62, 64 and are attached at opposite ends to the right and left return springs 90, 92, which are in turn attached to the frame. Intermediate portions of the right and left chains 86, 88 engage the second and third drive gears 78, 80 so that pulling movement of the chains cause rotation of the second and third drive gears. Intermediate portions of the return springs 90, 92 engage pulleys 94. A user moves the stepping members 54, 56 from their raised positions to their lowered positions by stepping on the stepping surfaces 58, 60. Movement of the right stepping member 54 from its raised position to its lowered position causes rotation of the flywheel 34 via the second drive gear 78, drive shaft 70, first drive gear 72, driven gear 74, and flywheel shaft 50. Likewise, movement of the left stepping member 56 from its raised position to its lowered position causes rotation of the flywheel 34 via the third drive gear 80, drive shaft 70, first drive gear 72, driven gear 74, and flywheel shaft 50. When the user lifts removes his/her weight from the stepping surface 58, 60, the return springs 90, 92 return the stepping member 54, 56 to their raised positions. Thus, a user can simulate climbing stairs by standing on the stepping members 54, 56 and alternately raising and lowering his/her feet.

Figure 4:
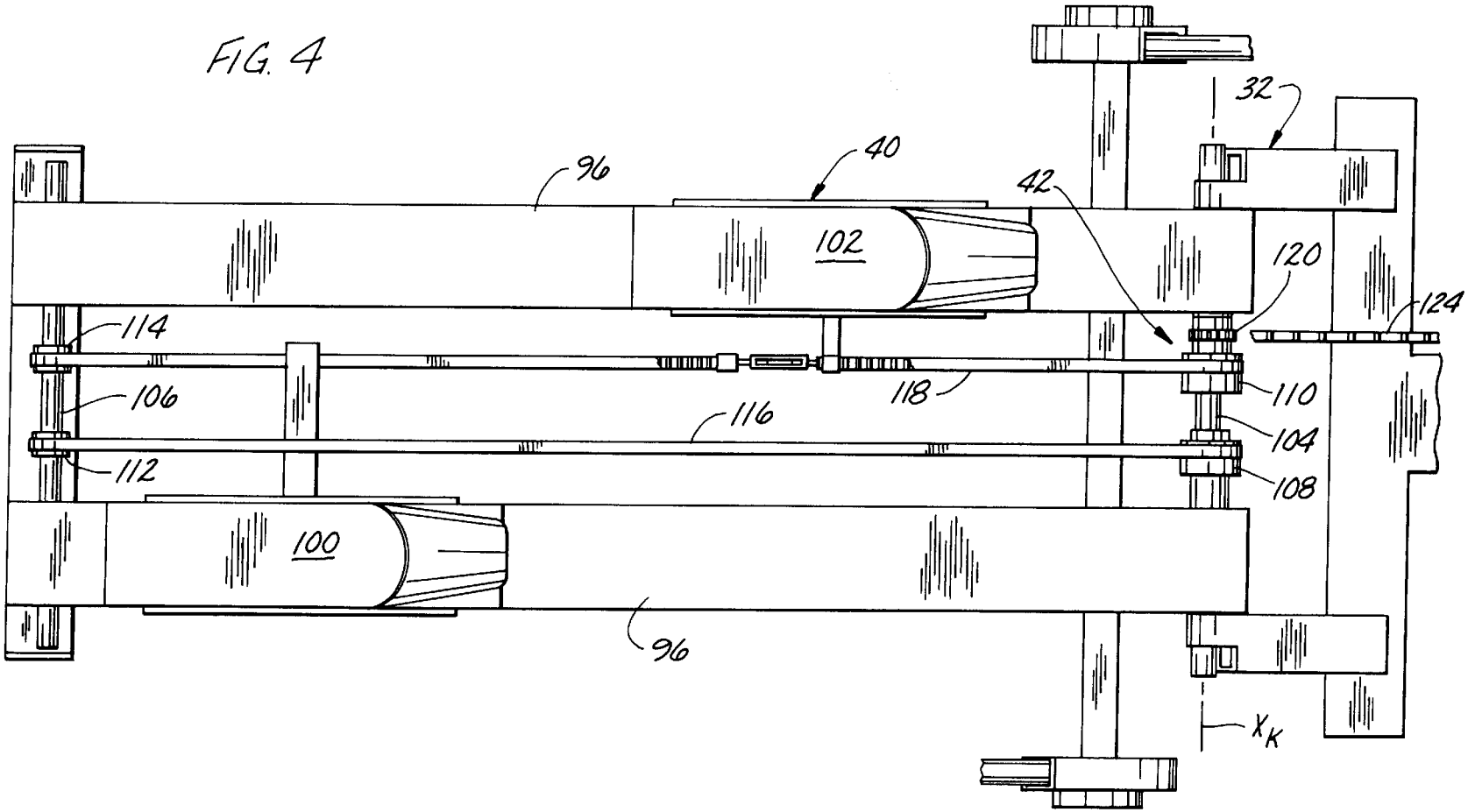
FIG. 4 is an enlarged fragmented top plan view of a rearward portion of the exercise machine of FIG. 1 showing a skirt mechanism of the machine.

The linear motion mechanism 40 of the present invention may be used for simulating either a skiing activity or a rowing activity. Preferably, the linear motion mechanism 40 comprises two generally horizontal elongate runners 96 and right and left skates 100, 102 configured for gliding on the runners. The elongate runners 96 constitute parts of the frame 32 and the skates 100, 102 constitute linearly moveable members. Each skate has a plurality of rollers (not shown) sized for riding in elongate tracks on opposite sides of the runners 96. The skates are configured for receiving the feet of a user and are linearly moveable along the runners between forward and rearward positions (FIGS. 1 and 4).

The skier drive mechanism 42 operatively couples the linear motion mechanism 40 to the flywheel 34 in a manner to cause the flywheel to rotate about the flywheel axis upon movement of either of the skates 100, 102 from their forward positions to their rearward positions. The drive mechanism 42 is referred to as a "skier" drive mechanism 42 for identification purposes only to distinguish it from other drive mechanisms described herein, and is not intended to limit its structure or function. In other words, the use of the phrase "skier drive mechanism" in the claims is not intended to require a skier-type apparatus. Thus, "skier drive mechanism" is appropriate even if the linear motion mechanism is used for simulating a rowing activity or some other linear motion activity.

The skier drive mechanism 42 is preferably a reduction transmission comprising a forward shaft 104, a rearward shaft 106, right and left forward pulleys 108, 110, right and left rearward pulleys 112, 114, right and left timing belts 116, 118, a drive gear 120, a ski sprocket wheel 122 (FIG. 2), and a chain 124. The forward shaft 104 extends laterally through forward ends of the runners 96 and is journaled in the frame 32 via suitable bearings for rotation about an axis $X_k$. The drive gear 120 is keyed to and rotates with the forward shaft 104. The right and left forward pulleys 108, 110 are coupled to the forward shaft 104 via one-way clutches. These clutches effect driving engagement between the forward pulleys 108, 110 and the forward shaft 104 when the forward pulleys are rotated in the first direction and allow free wheeling of the forward pulleys relative to the drive shaft in the opposite direction. Preferably, the forward pulleys 108, 110 have grooves (not shown) for intermeshing with cogs on the timing belts 116, 118. The rearward shaft 106 is preferably secured adjacent rearward ends of the runners 96. The right and left rearward pulleys 112, 114 are rotatably coupled to the rearward shaft 106 for free wheeling rotation relative to such shaft. The right timing belt 116 is secured to the right skate 100 and is trained around the right forward pulley 108 and the right rearward pulley 112. The left timing belt 118 is secured to the left skate 102 and is trained around the left forward pulley 110 and the left rearward pulley 114. Because of the belts, pulleys, and clutches, movement of either skate from its forward position to its rearward position causes the forward shaft 104 and drive gear 120 to rotate in the first direction, but movement of either skate from its rearward position to its forward position does not cause such rotation. The ski sprocket wheel 122 is coupled to the flywheel shaft 50 via a one-way clutch. The one-way clutch effects driving engagement between the ski sprocket wheel 122 and flywheel shaft 50 when the driven gear is rotated in a first direction (e.g., counter-clockwise as viewed in FIG. 2) and driving disengagement when the driven gear is rotated in an opposite direction (e.g., clockwise as viewed in FIG. 2). Accordingly, when the ski sprocket wheel 122 is rotated in the first direction, the flywheel shaft 50 and flywheel rotate with the ski sprocket wheel, and when the driven gear stops rotating, it permits the flywheel shaft and flywheel to continue rotating in such first direction. The chain 124 is trained around the drive gear 120 and the ski sprocket wheel 122 so that rotation of the drive gear causes rotation of the ski sprocket wheel. Thus, the skier drive mechanism 42 operatively couples the skates 100, 102 to the flywheel 34 in a manner to cause the flywheel to rotate about the flywheel axis upon movement of either of the skates 100, 102 from their forward positions to their rearward positions. Thus, a user can simulate cross-country skiing by standing on the skates 100, 102 and alternately moving his/her feet forward and rearward.

The cycling mechanism 44 comprises a crank shaft 130 (FIG. 3), a pair of offset cranks 132, and a pair of foot pedals 134. The crank shaft 130 is journaled in the frame 32 via suitable bearings for rotation about a crank axis $X_c$. The cranks 132 are keyed to opposite ends of the crank shaft 130 for rotation with the crank shaft. The foot pedals 134 are rotatably connected to the cranks 132. The cycling drive mechanism 46 operatively couples the crank shaft 130 of the cycling mechanism 44 to the flywheel 34 in a manner to cause the flywheel to rotate about the flywheel axis $X_f$ upon circular movement of the cranks 132 about the crank axis $X_c$. The cycling drive mechanism 46 is preferably a step-up transmission comprising a cycle sprocket wheel 136 keyed to and rotatable with the crank shaft 130, a driven gear 138 (FIG. 1) coupled to the flywheel shaft 50 via a one-way clutch mechanism, and a cycle chain 140 trained around the cycle sprocket wheel and the driven gear so that rotation of the cycle sprocket wheel causes rotation of the driven gear. Thus, movement of the cranks 132 in a circular direction causes rotation of the flywheel 34.

A cycle seat assembly, generally indicated at 142, is connected to the frame 32 for supporting a user in a seated position during operation of the cycling mechanism 44. The seat assembly 142 comprises a seat portion 144 and a seat support mechanism 146 for supporting the seat portion. The seat support mechanism 146 comprises a tubular-shaped beam 148 fixed to the frame 32, a support rod 150 releasably connectable to the beam, and a pair of flanges 152 secured to and extending downwardly from the seat portion 144. The seat assembly 142 is moveable between a first position (FIG. 1) and a second position (FIG. 2). The support mechanism 146 supports the seat assembly 142 in a recumbent position relative to the cranks 132 when the support mechanism is in its first position. The support mechanism 146 supports the seat portion 144 in an upright position relative to the cranks 132 when the support mechanism is in its second position. When the seat assembly 142 is in its recumbent position, the support rod 150 is generally horizontal and extends rearwardly from the upper end of the beam 148. Preferably, a recumbent support brace 154 (FIG. 1) is releasably connected to the end of the support rod 150 and engages the tops of the runners to support the rod in the recumbent position. The support rod 150 is shaped and configured for a telescoping fit in the tubular shaped beam 148 when the seat assembly 142 is in its upright position (FIG. 2) to adjust the height of the seat portion 144. The flanges 152 have appropriate holes and slots positioned for being adjustably aligned with holes in the support rod 150 for receiving pins for locking the flanges 152 to the support rod. Thus, the seat portion 144 is releasably secured to the end of the support rod 150 when the seat assembly 142 is in its upright position, and is releasably secured along the length of the support rod when the seat assembly is in its recumbent position. Thus, a user may use the exercise machine 30 to simulate an upright cycling activity or a recumbent cycling activity.

Figure 3:
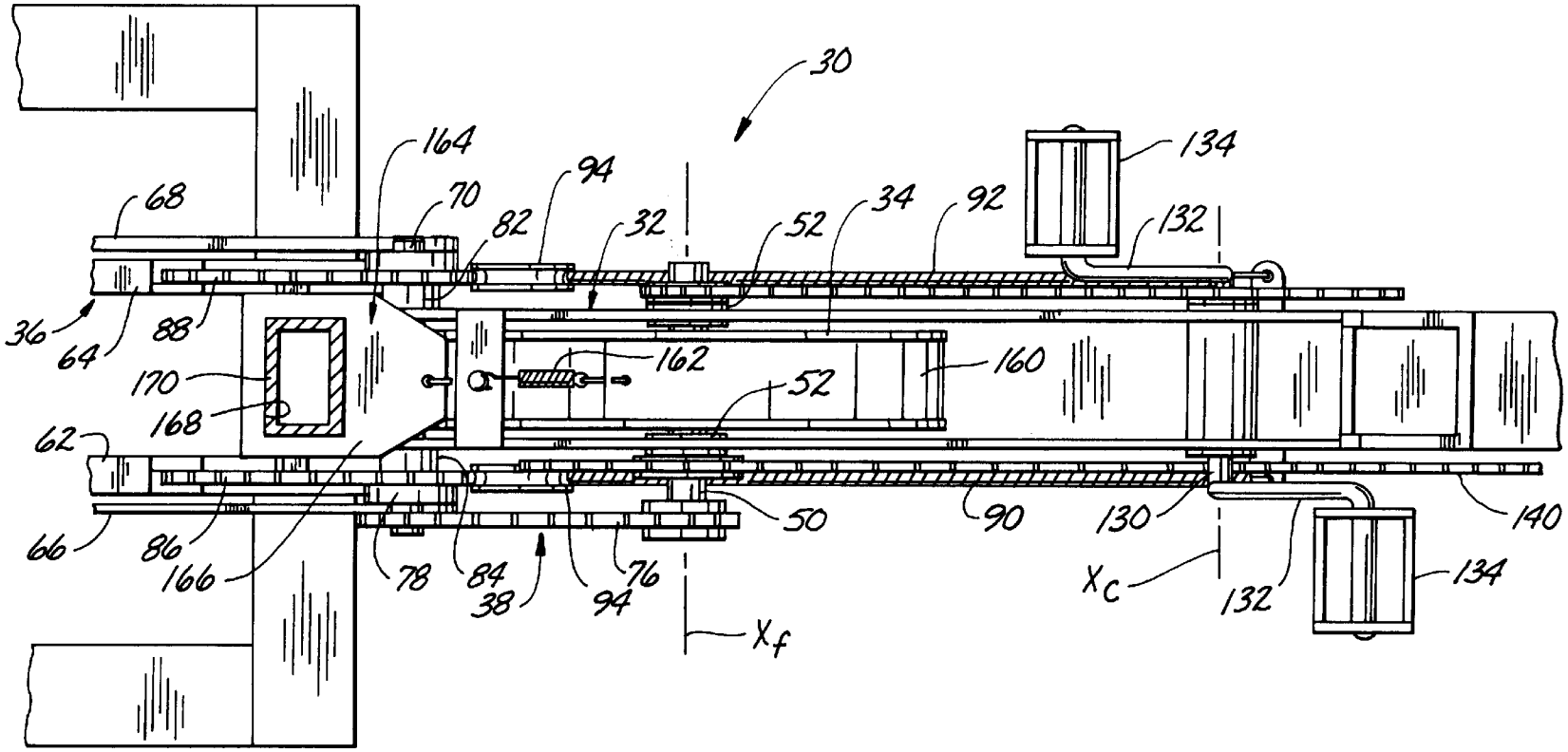
FIG. 3 is an enlarged fragmented top plan view of a forward portion of the exercise machine of FIGS. 1 and 2 showing drive mechanisms of the machine.

The exercise machine 30 further includes a resistance element configured for adjustably resisting rotation of the flywheel 34. Preferably the resistance element comprises a brake strap 160 engageable with the periphery of the flywheel 34 to resist rotation of the flywheel and flywheel shaft 50. The brake strap 160 is secured at one end to the frame 32 via a short tension spring 162. The brake strap 160 extends generally clockwise (as viewed in FIG. 2) around the periphery of the flywheel 34 and extends upward to a tensioning mechanism 164. As shown in FIG. 3, the tensioning mechanism 164 comprises a plate 166 having a rectangular shaped hole 168 therein. The hole 168 is shaped to enable the plate 166 to circumscribe a post 170 of the frame 32. The plate 166 is releasably slidable up and down to increase and decrease the tension on the strap 160. Because the strap 160 is secured to an end of the plate 166, the tension of the strap cants plate to releasably lock the plate to the post 170. To adjust the height of the plate 166 (and thus the tension of the strap 160), the plate is moved to a horizontal position to unlock it from the post 170 and is then raised or lowered. Thus, the rotational resistance of the flywheel 34 may be easily and quickly adjusted. Although the resistance element has been described as a manual mechanism, it is to be understood that computer controlled mechanisms may also be employed without departing from the scope of this invention.

In operation, a user can use the exercise machine 30 in a stair climbing mode, a skier mode, and a cycling mode. The user may adjust the brake strap 160 to a desired tension to provide the desired resistance for the flywheel 34. To operate the exercise machine 30 in the stair climbing mode, the user steps on the stepping members 54, 56 and alternately raises and lowers his/her feet in a stair-climbing manner. Preferably, the exercise machine 30 is provided with suitable handle bars 180 to enable the user to stabilize himself/herself when simulating a stair climbing activity. To operate the exercise machine in the skiing mode, a user stands on the skates 100, 102 and alternately moves his/her feet forward and rearward to thereby turn the flywheel 34. Preferably, poles 182 are pivotally connected to forward ends of the runners 96. The poles 182 function as ski poles when the exercise machine is operated in its skiing mode. To operate the exercise machine 30 in its cycling mode, the user adjusts the seat assembly 142 to its upright position or to its recumbent position. The user then sits on the seat portion 144 and pedals the cranks 132 to turn the flywheel 34. Preferably, the handle bars 180 may be turned from the position shown in FIG. 1 to the position shown in FIG. 2 so that the user can hold the handle bars when operating the exercise machine in the recumbent cycle mode.

Figure 5:
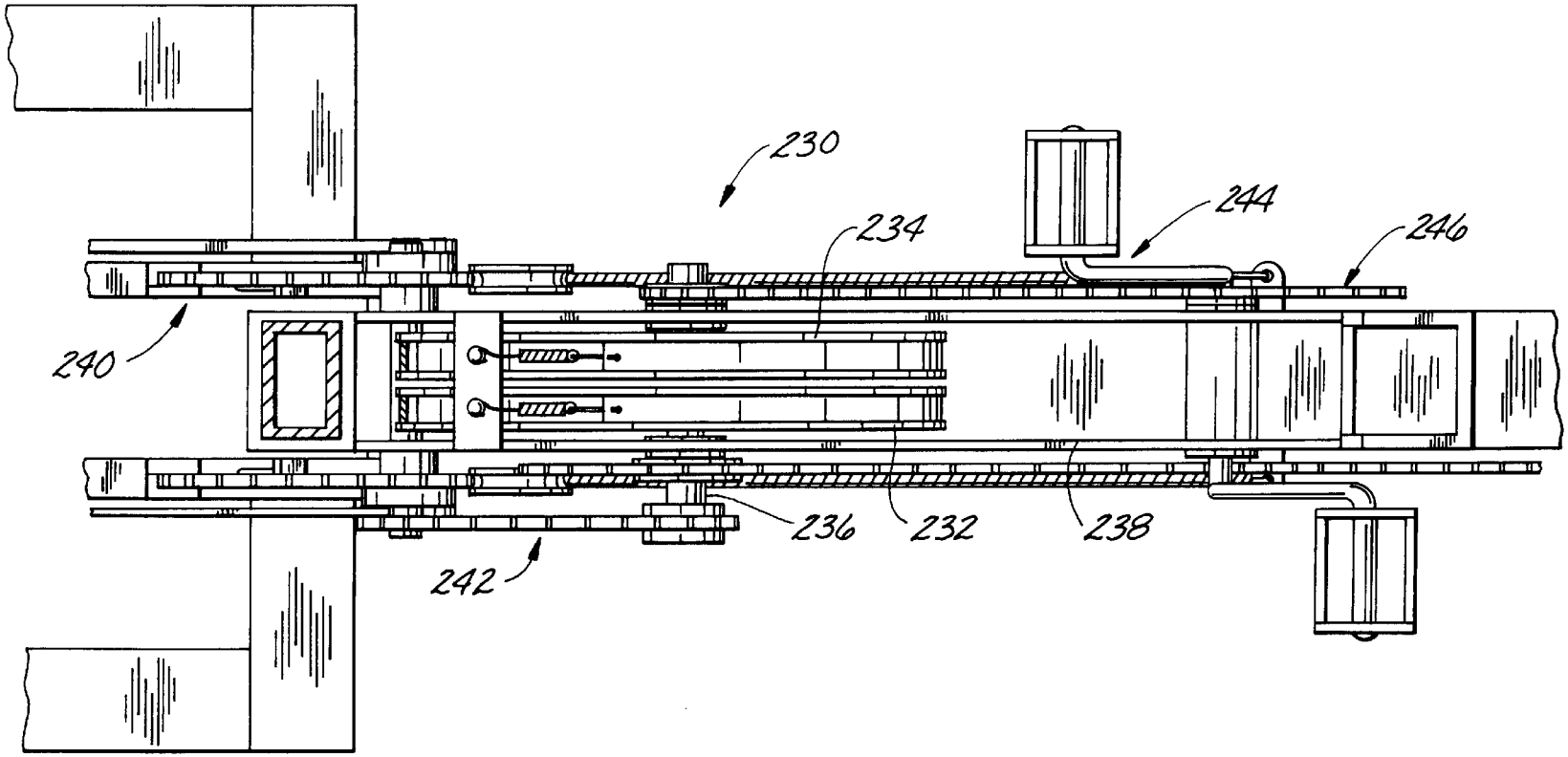
FIG. 5 is a cross-sectional view similar to that of FIG. 3 but of another exercise machine of the present invention.

Another exercise machine of the present invention is indicated generally at 230 in FIG. 5. The exercise machine 230 is similar to the exercise machine 30 of FIGS. 1–4 except the exercise machine 230 has multiple flywheels. In particular, the exercise machine 230 has a stair-climbing flywheel 232 and a cycle flywheel 234. The stair-climbing flywheel 232 is keyed to a flywheel shaft 236 which is journaled in a stationary frame 238 of the exercise machine 230 for rotation of the stair-climbing flywheel and flywheel shaft about a flywheel axis. The exercise machine 230 further includes a stair-climbing mechanism 240 and a stair-climbing drive mechanism 242. Preferably, the stair-climbing mechanism 240 is identical to the stair-climbing mechanism 36 and the stair-climbing drive mechanism 242 is identical to the stair-climbing drive mechanism 38. Also preferably, the stair-climbing drive mechanism 242 couples the stair-climbing mechanism 240 to the flywheel shaft 236 in the same manner as the stair-climbing drive mechanism 38 of FIGS. 1–3 couples the stair-climbing mechanism 36 to the flywheel shaft 50.

The cycle flywheel 234 is rotatably coupled to the flywheel shaft 236 via suitable bearings to enable the cycle flywheel to rotate about the flywheel axis independent of the rotation of the flywheel shaft and stair-climbing flywheel 232. The exercise machine 230 further includes a cycling mechanism 244 and a cycling drive mechanism 246. Preferably, the cycling mechanism 244 is identical to the cycling mechanism 44 of FIGS. 1–3. The cycling drive mechanism 246 couples the cycling mechanism 244 to the cycle flywheel 234 in a manner to rotate the cycle flywheel upon circular motion of the cycling mechanism. Although not shown, it is to be understood that a skier flywheel may be mounted to the frame rearward of the cycle mechanism for use with a linear motion mechanism.

With the exercise machine 230 of this embodiment, two or three users can simultaneously operate the various modes of the machine. In other words, one user can operate the machine 230 in the stair-climbing mode while another operates it in a cycling mode and yet another operates it in a skiing mode. Thus, one exercise machine may be used to simulate several different aerobic activities in a compact, space-saving manner In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. The invention therefore shall be limited solely by the scope of the claims set forth below.

What is claimed is:

1. An exercise machine operable in a first mode for simulating a cycling activity and operable in a second mode for simulating a stair climbing activity, said machine comprising:

a frame;

a flywheel operatively connected to the frame for rotation relative to the frame about a flywheel axis;

first and second stepping members operatively connected to the frame for movement relative to the frame between raised and lowered positions, each stepping member having a stepping surface positioned and configured to be stepped upon by a user;

a stair-climbing drive mechanism operatively connected to the stepping members and operatively connected to the flywheel in a manner to cause the flywheel to rotate about the flywheel axis upon movement of the stepping members from their raised positions to their lowered positions;

first and second cranks each operatively connected to the frame for motion in a circle relative to the frame; and a cycling drive mechanism operatively connected to the cranks and operatively connected to the flywheel in a manner to cause the flywheel to rotate about the flywheel axis upon circular movement of the cranks relative to the frame.

2. An exercise machine as set forth in claim 1 further comprising a resistance element configured for adjustably resisting rotation of the flywheel.

3. An exercise machine as set forth in claim 1 wherein the first and second cranks are operatively connected to the frame for motion in a circle about a crank axis, the crank axis and flywheel axis being different axes.

4. An exercise machine as set forth in claim 3 further comprising:

a shaft, the first and second cranks comprising a pair of offset cranks operatively connected to the shaft for rotation of the shaft about the crank axis upon rotation of the pair of offset cranks about the crank axis; and a pair of foot pedals connected to the cranks;

the cycling drive mechanism being operatively connected to the shaft in a manner to cause the flywheel to rotate about the flywheel axis upon rotational movement of the offset cranks about the crank axis.

5. An exercise machine as set forth in claim 4 wherein the cycling drive mechanism is a step-up transmission.

6. An exercise machine as set forth in claim 1 further comprising:

a linearly moveable member mounted on the frame for linear reciprocating movement along a longitudinal axis between forward and rearward positions; and a skier drive mechanism operatively connected to the linearly moveable member and operatively connected to the flywheel in a manner to cause the flywheel to rotate about the flywheel axis upon movement of the linearly moveable member between its forward and rearward positions in at least one direction.

7. An exercise machine as set forth in claim 1 wherein the skier drive mechanism is configured to cause the flywheel to rotate about the flywheel axis upon movement of the linearly moveable member from its forward position to its rearward position.

8. An exercise machine operable in a first mode for simulating an activity such as skiing or rowing involving reciprocating linear motion, and operable in a second mode for simulating a stair climbing activity, said machine comprising:

a frame;

a flywheel operatively connected to the frame for rotation relative to the frame about a flywheel axis;

first and second stepping members operatively connected to the frame for movement relative to the frame between raised and lowered positions, each stepping member having a stepping surface positioned and configured to be stepped upon by a user;

a stair-climbing drive mechanism operatively connected to the stepping members and operatively connected to the flywheel in a manner to cause the flywheel to rotate about the flywheel axis upon movement of the stepping members from their raised positions to their lowered position;

a linearly moveable member mounted on the frame for linear reciprocating movement along a longitudinal axis between forward and rearward positions; and a skier drive mechanism operatively connected to the linearly moveable member and operatively connected to the flywheel in a manner to cause the flywheel to rotate about the flywheel axis upon movement of the linearly moveable member between its forward and rearward positions in at least one direction.

9. An exercise machine as set forth in claim 8 further comprising a resistance element configured for adjustably resisting rotation of the flywheel.

10. An exercise machine as set forth in claim 9 further comprising:

first and second cranks each operatively connected to the frame for motion in a circle relative to the frame; and a cycling drive mechanism operatively connected to the cranks and operatively connected to the flywheel in a manner to cause the flywheel to rotate about the flywheel axis upon circular movement of the cranks relative to the frame.

11. An exercise machine as set forth in claim 8 wherein the skier drive mechanism is a reduction transmission.

12. An exercise machine operable in a first mode for simulating an activity such as skiing or rowing involving reciprocating linear motion, and operable in a second mode for simulating a cycling activity, said machine comprising:

a frame;

a flywheel operatively connected to the frame for rotation relative to the frame about a flywheel axis;

a linearly moveable member mounted on the frame for linear reciprocating movement along a longitudinal axis between forward and rearward positions;

a skier drive mechanism operatively connected to the linearly moveable member and operatively connected to the flywheel in a manner to cause the flywheel to rotate about the flywheel axis upon movement of the linearly moveable member between its forward and rearward positions in at least one direction;

first and second cranks each operatively connected to the frame for motion in a circle relative to the frame; and a cycling drive mechanism operatively connected to the cranks and operatively connected to the flywheel in a manner to cause the flywheel to rotate about the flywheel axis upon circular movement of the cranks relative to the frame.

13. An exercise machine as set forth in claim 12 further comprising:

first and second stepping members, each of said stepping members being operatively connected to the frame for movement relative to the frame between raised and lowered positions, the first and second stepping members being moveable independently of each other between their raised and lowered positions, the first stepping member having a first stepping surface and the second stepping member having a second stepping surface, the stepping surfaces being positioned and configured to be stepped upon by a user; and a stair-climbing drive mechanism operatively connected to the first and second stepping members and operatively connected to the flywheel in a manner to cause the flywheel to rotate about the flywheel axis upon movement of either of the first and second stepping members from its raised position to its lowered position.

* * * * *